US007690533B2

(12) United States Patent
Stilley

(10) Patent No.: US 7,690,533 B2
(45) Date of Patent: Apr. 6, 2010

(54) LIGHTED PRODUCT DISPENSER

(75) Inventor: Russell L. Stilley, Kingwood, TX (US)

(73) Assignee: Soap Labs, LLC, Allen, TX (US)

( * ) Notice: Subject to any disclaimer, the term of this patent is extended or adjusted under 35 U.S.C. 154(b) by 342 days.

(21) Appl. No.: 11/636,732

(22) Filed: Dec. 11, 2006

(65) Prior Publication Data

US 2009/0166378 A1 Jul. 2, 2009

Related U.S. Application Data

(60) Provisional application No. 60/749,847, filed on Dec. 13, 2005.

(51) Int. Cl.
*B05B 11/00* (2006.01)
*A63H 5/00* (2006.01)
*F21V 33/00* (2006.01)

(52) U.S. Cl. ..... 222/113; 222/39; 222/192; 222/321.7; 222/321.9

(58) Field of Classification Search ..... 222/39, 222/321.7, 78, 113, 192, 321.9, 321.8, 402.13, 222/153.11
See application file for complete search history.

(56) References Cited

U.S. PATENT DOCUMENTS 4,261,026 A 4/1981 Bolha
4,515,295 A 5/1985 Dougherty
4,516,697 A 5/1985 Dreps et al.
5,070,435 A 12/1991 Weller
5,489,893 A * 2/1996 Jo et al. ..... 340/686.4
5,536,196 A * 7/1996 Sternberg ..... 446/81
5,544,770 A * 8/1996 Travisano ..... 215/230
5,609,409 A 3/1997 Diehl
5,624,177 A 4/1997 Rosaia
5,664,703 A 9/1997 Reifenberger
5,683,168 A 11/1997 Teig et al.
5,771,925 A 6/1998 Lewandowski
5,785,407 A * 7/1998 Ratcliffe et al. ..... 362/101
6,315,163 B1 * 11/2001 Shu ..... 222/39
6,345,731 B2 * 2/2002 Bitton ..... 222/78
6,349,851 B1 2/2002 Lu
6,390,333 B1 5/2002 Bozzo
6,527,402 B1 3/2003 Borri
6,545,594 B1 4/2003 Knight et al.
6,557,728 B1 5/2003 Anderson et al.
6,588,435 B1 7/2003 Gindi
6,592,007 B2 * 7/2003 Ho et al. ..... 222/78
6,769,631 B2 8/2004 Brown
6,793,362 B2 9/2004 Tai
6,796,670 B2 9/2004 Winters et al.
6,890,162 B2 * 5/2005 Ding ..... 417/572

(Continued)

OTHER PUBLICATIONS

Snow Globe Pump, photographs, writeup, 1 page.

(Continued)

*Primary Examiner*—Kenneth Bomberg
(74) *Attorney, Agent, or Firm*—Roger N. Chauza, PC

(57) ABSTRACT

A container for dispensing liquids or gels, where the container includes a light module, a sound module, or both. When the contents of the container are dispensed by the user, light is automatically dispersed inside the container and into the contents to provide a desired visual effect for attraction of consumers to the product.

10 Claims, 12 Drawing Sheets

U.S. PATENT DOCUMENTS

| | | | | |
|---|---|---|---|---|
| 6,955,443 | B2 | 10/2005 | Solowiej | |
| 6,969,209 | B2 | 11/2005 | Apar et al. | |
| 7,063,432 | B2 | 6/2006 | VanderSchuit | |
| 7,080,916 | B1 | 7/2006 | Ferrin et al. | |
| 7,258,458 | B2 * | 8/2007 | Mochiachvili et al. | 362/96 |
| 7,260,944 | B2 * | 8/2007 | Anthony | 62/77 |
| 2003/0006247 | A1 * | 1/2003 | Olivier et al. | 222/83 |
| 2004/0218402 | A1 * | 11/2004 | Jao | 362/555 |
| 2005/0205605 | A1 * | 9/2005 | Clapper | 222/113 |
| 2006/0250795 | A1 * | 11/2006 | Langone | 362/253 |
| 2007/0007304 | A1 * | 1/2007 | Bitton | 222/113 |

OTHER PUBLICATIONS

Snowman Pump, photographs, writeup, 1 page.
Illuminated Drinking Glass, photograph, wrtiteup, 1 page.

* cited by examiner

LIGHTED PRODUCT DISPENSER

RELATED APPLICATIONS

This non-provisional patent application claims the benefit of U.S. provisional patent application No. 60/749,847, filed Dec. 13, 2005, the disclosure of which is incorporated herein by reference.

TECHNICAL FIELD OF THE INVENTION

The present invention relates in general to product dispensers, and more particularly to lighted liquid product dispensers.

BACKGROUND OF THE INVENTION

Many products are used by consumers by dispensing the product and using the product for its intended purpose. Many products are marketed in dispensers so that the consumer purchases both the product and the dispenser together. Liquid soap, lotions, various gel-related products, liquid cleaning products, etc., are sold in dispensers which contain the product. Many of these products, and others, are dispensed by the use of a pump which is integrated with a cap which screws onto the threaded opening of the container. When the product is desired, the consumer simply depresses the pump and the product is pumped out of the dispenser spout. Other containers are adapted for squeezing by the consumer to dispense the liquid from a pop-up or pull-up type opening in the cap.

As can be appreciated, the successful marketing of products is not limited to the quality or type of product itself, but also by the packaging of the product. Indeed, the appeal to many consumers is often to the packaging, and less to the product. The fanciful packaging of products adds appeal to the consumer whose attention may be first attracted to the packaging and then to the product itself. This aspect of marketing is even more pronounced when the product is one that is used by children, who want products that are exciting to look at and handle, and provide an interaction with the user. For example, U.S. Pat. No. 6,592,007 by Ho et al., discloses a dispenser that is equipped with a pump so that when the hand operated plunger of the pump is pushed, a circuit is activated to rotate an object in the container to circulate the liquid and objects, such as miniature toy fish suspended in the liquid. U.S. Pat. No. 6,557,728 by Anderson et al., discloses a musical toothpaste tube having a cap which, when opened, causes music to be played.

From the foregoing, it can be seen that a need exists for additional marketing enhancements for products to better attract purchasers. A need exists for product dispensers which illuminate the product itself, or the interior of the container when the user initiates dispensing of the product. Another need exists for a product dispenser which produces light and/or sound in response to the application of a pressure to the dispenser.

SUMMARY OF THE INVENTION

In accordance with the principles and concepts of the invention, there is disclosed a product dispenser which produces light or sound, or both, when pressure is applied to the dispenser to dispense the product.

In accordance with one feature of the invention, a light or sound module is activated when the pump of the dispenser is pushed.

In accordance with another feature of the invention, a light or sound module is activated when the container of the product is squeezed to dispense the product.

In accordance with yet another feature of the invention, the light module can be attached to the container of the dispenser, to the top thereof, the bottom, the side, or inside the container.

In accordance with an embodiment of the invention, disclosed is a product dispenser for dispensing a product by a user. The dispenser includes a container for containing the product, and means for manually pressing by the user to dispense the product from the container. A light module for controlling a light emitter is included, where the light module is attached to the dispenser, and the light module is responsive to the means for manually pressing for activating the light emitter for illuminating the container.

In accordance with another embodiment of the invention, disclosed is a product dispenser for dispensing a product by a user. The dispenser includes a container for containing the product, and a pump attached to the container, where the pump is responsive to pressing by a user for dispensing the product. Also included is a light module for controlling a light emitter, where the light module is carried with the container. A pressure sensitive switch is electrically connected to the light module. The switch is located so that when pressure is applied to the pump to dispense the product, the switch is activated to cause the light module to illuminate the light emitter.

BRIEF DESCRIPTION OF THE DRAWINGS

Further features and advantages will become apparent from the following and more particular description of the preferred and other embodiments of the invention, as illustrated in the accompanying drawings in which like reference characters generally refer to the same parts, functions or elements throughout the views, and in which.

DETAILED DESCRIPTION OF THE INVENTION

Figure 1A:
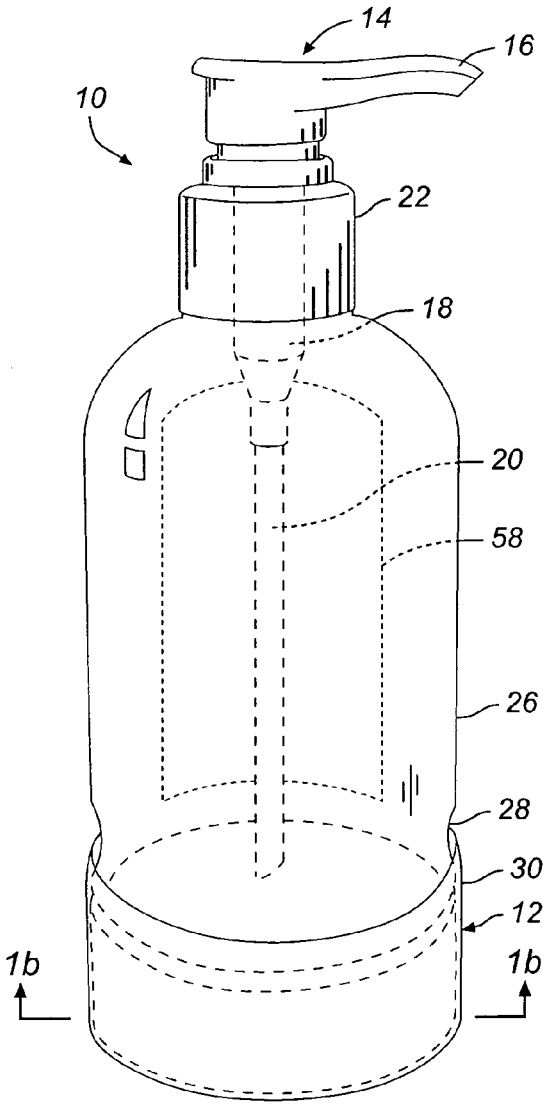
FIG. 1*a* is a side view of a pump-type dispenser according to one embodiment of the invention, in which a light source illuminates the internal space of the container, and sounds are emitted.

With reference to FIGS. 1*a*-1*d*, there is shown a pump-type dispenser 10 of conventional design, but with a light/sound module 12 attached to the bottom thereof. The dispenser 10 includes a pump mechanism 14 having a spout 16, a pump 18 and a suction tube 20. The pump mechanism 14 is attached to a threaded cap 22 which can be attached to the threaded opening 24 (FIG. 1*b*) of a product container 26, preferably for containing and dispensing a liquid or gel product. The container 26 is preferably constructed of a clear plastic material so that the product or contents is visible. In the embodiment shown in FIG. 1*a*, the container 26 is formed with an annular indented area 28 near the bottom thereof. Blow molding techniques can be employed to form the container 26.

According to an important feature of the invention, the light/sound module 12 is attached to the bottom of the container 26 so that light emitted from the module 12 is directed into the interior of the container 26, and into the contents. Although not limited to such type of product, the container and pump 14 are well adapted for containing and dispensing a liquid or gel-based product. The light/sound module 12 is attached to the bottom of the container 26 by a sleeve of a heat shrinkable material 30. The heat shrinkable sleeve 30 can be colored and opaque, and can have advertising or instructional matter printed thereon. As an alternative, the module 12 can be attached to the container with an adhesive, tape or other bonding agent or mechanism. As can be appreciated, when the heat shrinkable sleeve 30 is shrunk to attach the light/sound module 12 to the container 26, at least a portion of the sleeve 30 shrinks into the annular indented area 28 and prevents axial movement of the light/sound module 12.

Figure 1B:
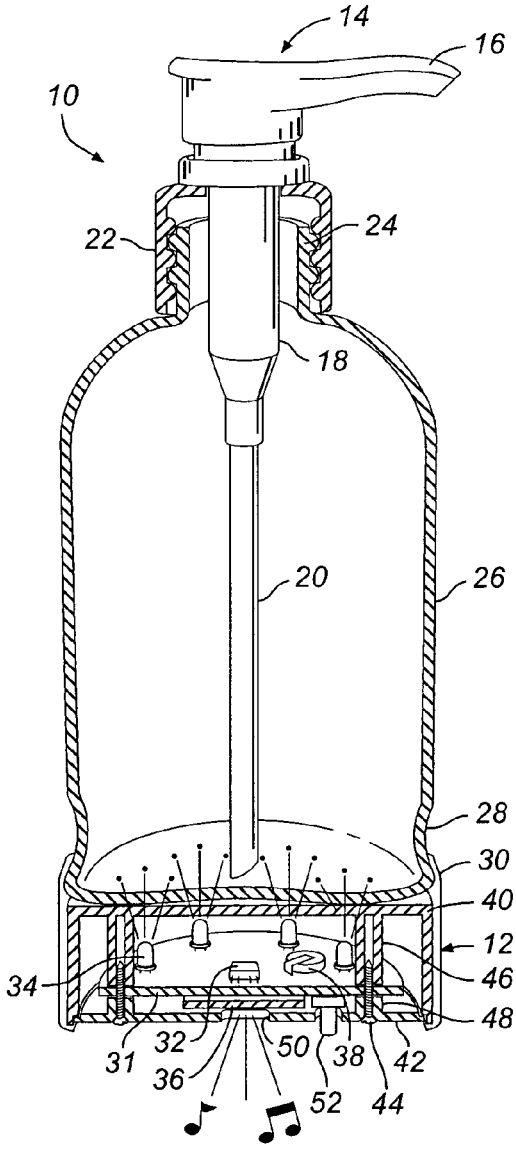
FIG. 1*b* is a cross-sectional view of the pump-type dispenser, taken along line 1*b*-1*b* of FIG. 1*a;*
Figure 1C:
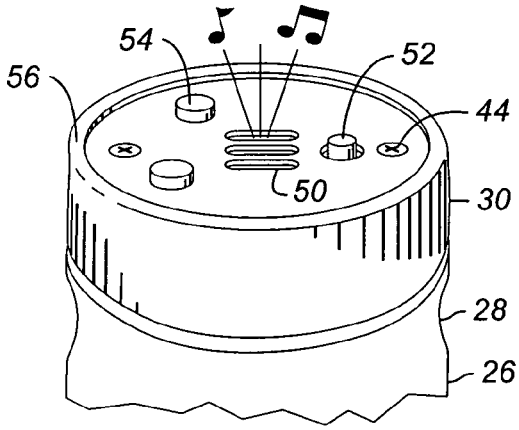
FIG. 1*c* is an isometric view of the bottom of the pump-type dispenser of FIG. 1, showing the placement of the feet and the activation switch.
Figure 1D:
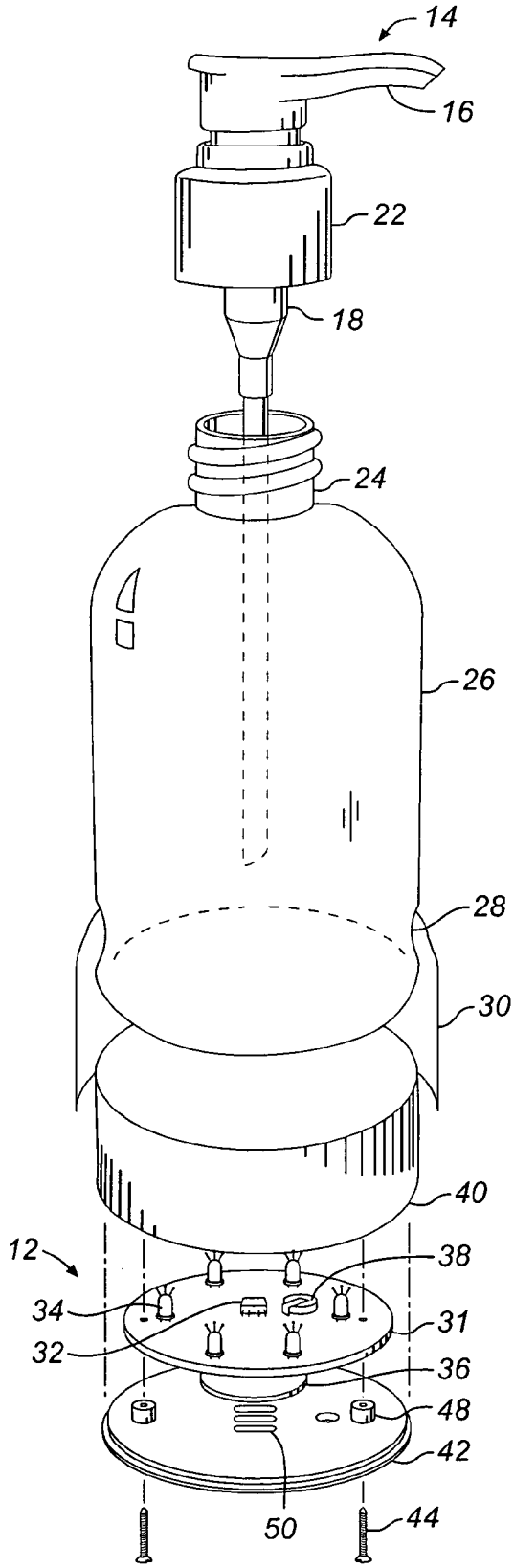
FIG. 1*d* is an exploded view of the various components of the pump-type dispenser of FIG. 1*a;*

With reference not to FIGS. 1*b*-1*d*, the details of the light/sound module 12 are illustrated. The module 12 is constructed using a small printed circuit board 31 or an encapsulated module, having a number of electronic components. The light/sound module 12 includes an integrated circuit 32 that controls the audio/visual components. The integrated circuit 32 is of conventional design for providing a predetermined pattern of lighting of the light emitting diodes, one shown as reference numeral 34. The light emitting diodes 34 can emit different colors at different times, and in synchronism with the sound produced by a piezoelectric speaker 36. The integrated circuit 32 is adapted for storing sounds, such as a short musical song or other audio message. The timing of the light display and the sound, as well as the duration of the display is stored or otherwise generated by the integrated circuit 32. The integrated circuit 32 is connected to the piezoelectric speaker 36 or other sound transducer to convert the electrical signals to sound. The speaker 36 is mounted to the bottom of the printed circuit board 31 so as to emit sound downwardly, as shown in FIG. 1*b*. A battery 38 is mounted to the printed circuit board 31 for providing a source of DC power to the integrated circuit 32 and the components driven thereby.

A case for the light/sound module 12 is constructed of plural plastic parts, including a top case 40 and a bottom case 42. Two screws, one shown as numeral 44, are used to fasten the top case 40 to the bottom case 42, with the printed circuit board 31 captured therebetween. This is shown in FIG. 1*b*. The printed circuit board 31 is spaced from the bottom of the container 26 by the use of a pair of posts 46 formed on the top case 40, and a corresponding pair of posts 48 formed on the bottom case 42. The printed circuit board 31 is sandwiched between the posts 46 and 48, so that the screws 44 pass freely through the bottom posts 48, then through holes in the printed circuit board 31, and then are threaded into the holes formed in the top posts 46.

The bottom case 42 fits within an annular corner formed in the bottom circumferential edge of the top case 40. The bottom case 42 is recessed somewhat from the circumferential edge of the top case 40, as shown in FIG. 1*c*. The bottom case 42 has formed therein a hole or ports 50 below the speaker 36 for allowing the sound generated by the speaker 36 to be emitted out of the bottom of the light/sound module 12. Formed on the underside of the bottom case 42 are a pair of spaced apart foot posts, one shown by numeral 54. A momentary push-type switch 52 is attached to the conductors of the printed circuit board 31 so as to allow the stem of the switch 52 to protrude through a hole in the bottom case 42. As can be seen in FIG. 1*c*, the sleeve 30 envelopes the bottom edge of the top case 40. The two posts 54 and the stem portion of the switch 52 protrude beyond the underside of the bottom case 42 about one sixteenth of an inch. The switch 52 is of the type that is momentarily activated when pushed several thousandths of an inch. Once pushed, the switch 52 activates the integrated circuit 32 to produce the light pattern and the sound for a predetermined period of time.

The posts 54 of the bottom case 42 are spaced apart from each other, as well as from the switch 52 so that whenever the pump 14 is pushed by the user, the stem of the switch 52 is depressed and the light and audio sounds are emitted. To that end, the posts 54 and the stem of the switch 52 protrude a short distance beyond the bottom of the annular lip 56 of the sleeve 30. Importantly, the switch 52 is internally spring loaded so that it is not activated when the container is full of the product and when sitting on a surface in the upright position. However, the switch 52 is activated when an additional load or pressure is applied to it by way of the user pushing on the pump 14. This depresses the stem of the switch 52 several thousandths of an inch to thereby activate the integrated circuit 32.

As shown in FIG. 1*b*, the light emitting diodes 34 are oriented upwardly adjacent to the bottom of the container 26. The light emitted by the diodes 34 is directed into the container 26 and into the contents of the container 26. The various colors of light traveling through and dispersed by the liquid or gel provides a visual display to the user each time the product is dispensed. As noted above, the light emitted by the diodes 34 can be synchronized with the music produced by the speaker 32. For an additional visual effect, small particles, flecks or flakes of a shiny material can be mixed with the product to produce light scintillations. Also, small voids or bubbles formed in the liquid or gel can be used to further disperse the light in the product and produce interesting visual effects. To further enhance the visual effect of the light emitted into the container 26, provided is a label 58 constructed with an inner reflective surface. The label 58 can be constructed with a reflective foil surface that is adhered to the side of the container 26. The outside surface of the label 58 can be printed with instructions, a bar code, ingredients, etc., in a conventional manner.

The product dispenser 10 can be easily produced by assembling the light/sound module 12 as a unit, and then fastening the module 12 to the product-filled container 26 using the heat shrinkable sleeve 30. The assembly of the product dispenser 10 is easy and can be accomplished in an assembly line, either manually or automatically. Importantly, the invention can be employed using a conventional pump-type dispenser without any modifications thereto. The light/sound modules 12 can be mass produced to attract different types of users. For example, light/sound modules 12 can be produced and programmed to produce music especially adapted for young children, or intermediate age girls or boys, or adults. The colors and labels can be adapted to also be attracted to specific types of users. For example, the integrated circuit 32 can be programmed to produce music which is liked by young girls, and the labels can be pink and display princesses or other images to which young children are currently attracted.

As noted above, the pump 14 is of conventional construction. To that end, the pump 14 is constructed so that it can be placed in a locked position to prevent the pumping of the contents, even if pressure is applied to the pump 14. Once the container 26 has been filled, the pump 14 is placed in the locked position. When a user desires to dispense the contents a first time, the spout 16 is rotated so that the pump 14 can be placed in an unlocked condition to dispense the contents of the container 26. According to an important feature of the invention, the visual and/or audible features of the product dispenser 10 can be demonstrated to persons shopping at a retail store, without unlocking the pump 14 and placing it in the dispensing condition. Rather, the pump 14 can remain in the locked position, and potential customers can nevertheless press on the pump 14 so that pressure is applied to the dispenser 10 sufficiently to actuate the switch 52. Once the switch 52 is actuated, the light/sound module 12 will cause the light display to begin and sounds to be emitted from the speaker 36. After a specified period of time, the light/sound module 12 will automatically return to the off state. A label or other tag attached to the product dispenser 10 can provide instructions to the potential customers as to the initiation of the light/sound module 12 for demonstration purposes. Shelf displays near the produce dispenser 10 can also be used to provide potential customers with the necessary instructions as to the manner in which the light/sound module 12 can be activated. The instructions can include a catch phrase, such as "Try Me" with an arrow and picture or simple diagram showing the person how to push on the pump to activate the light and/or sound mechanism. Such a feature will facilitate sales of the product dispenser 10, in that potential customers can try or test the light/sound feature without purchasing the product. The other embodiments of the invention described below also include this marketing feature.

Another embodiment 60 of the invention is shown in FIGS. 2*a*-2*d*. Here, a conventional pump-type container 26 is employed, including a standard product pump 14 and a clear or transparent plastic container 26. A light/sound module assembly 74 is attached to the product dispenser at the top thereof, rather than the bottom as described above in connection with FIGS. 1*a*-1*d*. The light/sound module assembly 74 is attached to the pump-type container without modifications to the container or product. As will be described below, the light/sound module assembly 74 moves up and down with the pump 14 as the product is being dispensed.

Figure 2A:
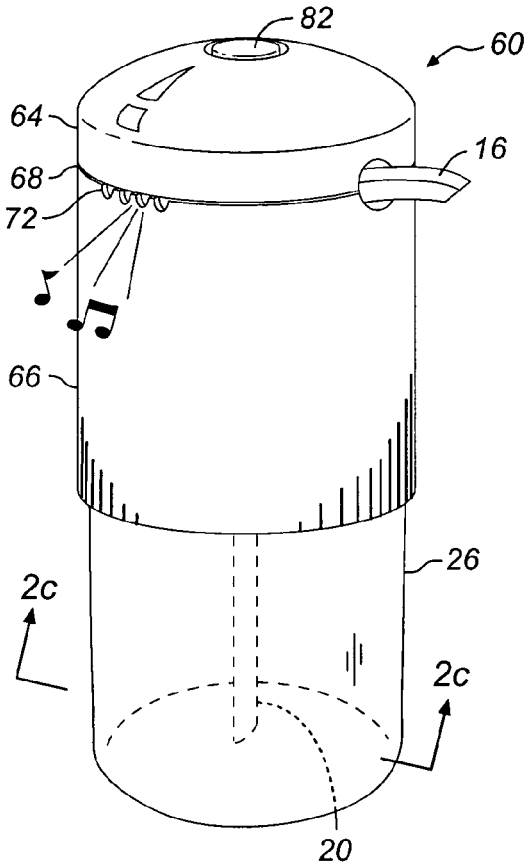
FIG. 2*a* is an isometric view of another embodiment of a pump-type dispenser according to the invention, in which the light source is located above the pump mechanism.
Figure 2B:
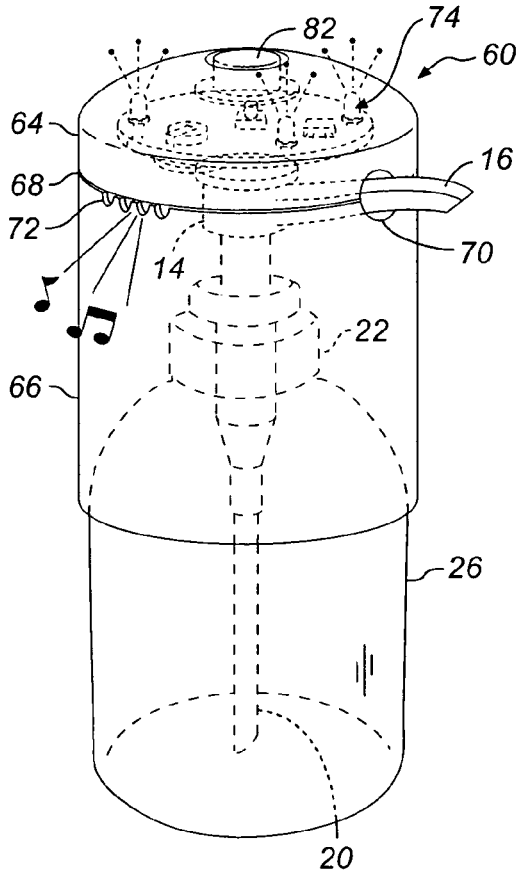
FIG. 2*b* is an isometric view of the pump-type dispenser of FIG. 2*a*, with the internal components shown in broken line.
Figure 2D:
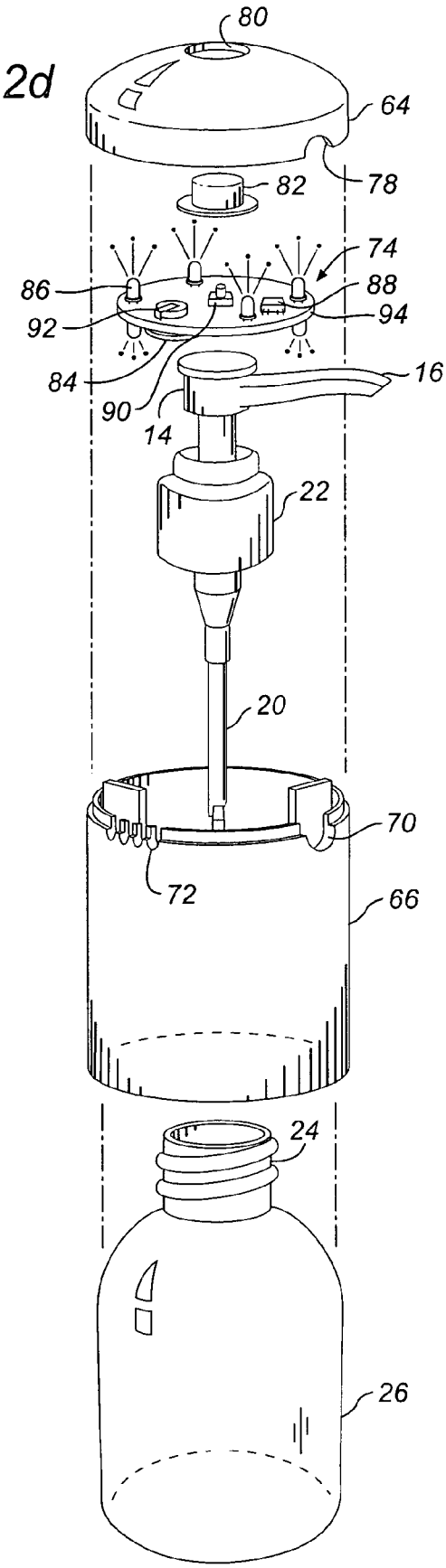
FIG. 2*d* is an exploded view of the various components of the pump-type dispenser of FIG. 2*a;*
Figure 2C:
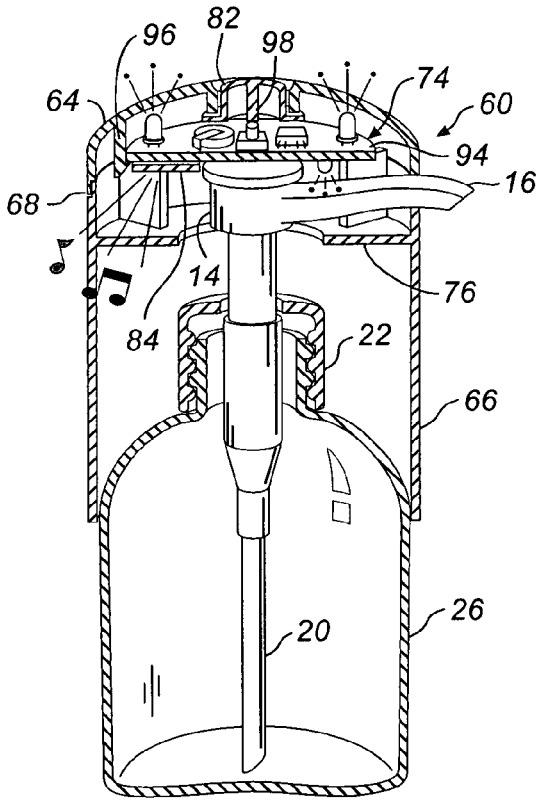
FIG. 2*c* is a cross-sectional view of the pump-type dispenser taken along line 2*c*-2*c* of FIG. 2*a;*

The light/sound module assembly 74 is attached around the pump 14 so as to be rotatable to lock and unlock the pump 14, as well as moves up and down during the dispensing of the product from the container 26. The light/sound module assembly 74 includes a top case 64 and a bottom case 66, both constructed of a clear acrylic, ABS, polycarbonate or other suitable plastic material adapted for injection molding. The top case 64 and the bottom case 66 are assembled together and fastened by snap fitting the parts together at the annular interface 68. Conventional catches and tangs (not shown) can be employed to snap the cases 64 and 66 together. The bottom case 66 is cylindrical in shape and is somewhat larger in diameter than the container 26 to which it is attached. This allows the bottom case 66 to telescopically slide over the top portion of the container 26 during dispensing of the product. When the pump 14 is in its fully up position, the lower portion of the bottom case 66 is situated around the larger diameter portion of the container, as shown in FIG. 2*c*, to provide lateral stability to the bottom case 66. The bottom case 66 includes a cutout 70 formed in the upper annular edge to accommodate the pump spout 16. Formed in the upper annular edge of the bottom case 66 are a number of other cutouts 72 for allowing sound to be emitted from the speaker of the light/sound module 74.

Formed within the bottom case 66 are a number of ribs 76 forming a central opening therein through which the pump 14 extends until engaged with the bottom of the pump 14, as shown in FIG. 2*c*. With this construction, when the spring action of the pump 14 causes it to rise after the user has released it, the pump 14 carries with it the light/sound module assembly 74.

The top case 64 is constructed to hold the light/sound module 74 therein, and to activate the module 74 when the top case 64 is depressed by the user to dispense the product from the container 26. As noted above, the top case 64 is snap locked to the bottom case 66 after the pump 14 has been captured therein to form a unit. The top case 64 is dome shaped, although many other aesthetically pleasing shapes could be employed, even the shape and appearance of popular characters and figures. The top case 64 is constructed with a cutout 78, complementary in shape and location to the cutout 70 in the bottom case 66, to accommodate the spout 16 of the pump. The top case 64 is also constructed with a central opening 80 through which a switch button 82 extends. Preferably, the switch button 82 does not extend beyond the upper surface of the top case 64 to thereby prevent inadvertent activation of the light/sound module 74 during shipping and inventory handling. In order to provide the desired visual effect, the top case 64 can be constructed of a clear or translucent plastic to allow light to emitted therethrough from the light/sound module 74. To that end, the top case 64 could also be constructed with facets to produce various effects on the emitted light, or constructed with imbedded flecks or particles of light reflective material.

The light/sound module 74 includes a piezoelectric speaker 84, one or more light emitting diodes 86, an integrated circuit 88, a spring-loaded switch 90 and a battery 92, all mounted to a printed circuit board 94. The switch 90 is of the momentary type in which very little axial movement of the stem is necessary for activation thereof. The speaker 84 is mounted to the bottom of the printed circuit board 94, as shown in FIG. 2*c*, and the printed circuit board 94 is oriented so that the speaker 84 is adjacent to the small cutouts 72.

The light/sound module 74 is mounted to the top case 64 by plural engaging posts, one shown as numeral 96. The posts 96 are formed with a notch therein for engaging the edge of the printed circuit board 94. The posts 96 can each have a beveled end so that the printed circuit board can be pushed thereagainst during installation to force the posts apart. When the printed circuit board 94 is pushed further, the notches of the posts 96 engage with the edge of the printed circuit board 94, whereupon the printed circuit board 94 becomes captured in top case 64. Prior to the assembly of the light/sound module 74 in the top case 64, the switch button 82 is set in the opening 80 of the case 64, and then the printed circuit board 94 is installed as set forth above. The switch button 82 includes a depending post 98 which abuts against the stem of the switch 90. Thus, pushing the top of the switch button 82 is effective to activate the switch 90.

The lighted product dispenser 60 is assembled in the following manner. First, the pump 14 is removed from the container 26, and the suction tube 20 and cap 22 of the pump are inserted through the ribs 76 of the bottom case 66. The cutout 70 of the bottom case 66 is registered with the bottom of the pump spout 16. The pump 14 and bottom case 66 are then reinstalled on the container 26 by screwing the cap 22 onto the threaded opening of the container 26. Then, the top case 64, with the light/sound module 74 fixed therein as described above, is slipped down over the pump 14 so that the bottom annular edge of the top case 64 snaps onto the upper annular edge of the bottom case 66. The top case 64 and the bottom case 66 can be glued or otherwise bonded together without the use of snap fitting tangs. The cutout 78 formed in the top case 64 is registered with the top of the spout 16. The cutouts 70 and 78 in the bottom and top cases thus envelope the spout 16 of the pump 14. In this position of the parts, the bottom of the printed circuit board 94 rests on the top flat surface of the pump 14, as shown in FIG. 2*c*. The lighted case can then be rotated to lock and/or unlock the pump 14. When it is desired to dispense the product contained in the container 26, the user need only push downwardly generally on the top of the domed top case 64, whereupon the slight depression of the button 82 activates the switch 90 and light is directed upwardly through the domed top case 64, and sound from the speaker 84 is directed out of the small cutouts 72 in the bottom case 66. Light emitting diodes are shown mounted on the bottom of the printed circuit board 94 to direct light downwardly into the container 26 and the product therein. Alternatively, light emitting diodes 86 could be mounted on both sides of the printed circuit board 94.

Figure 2E:
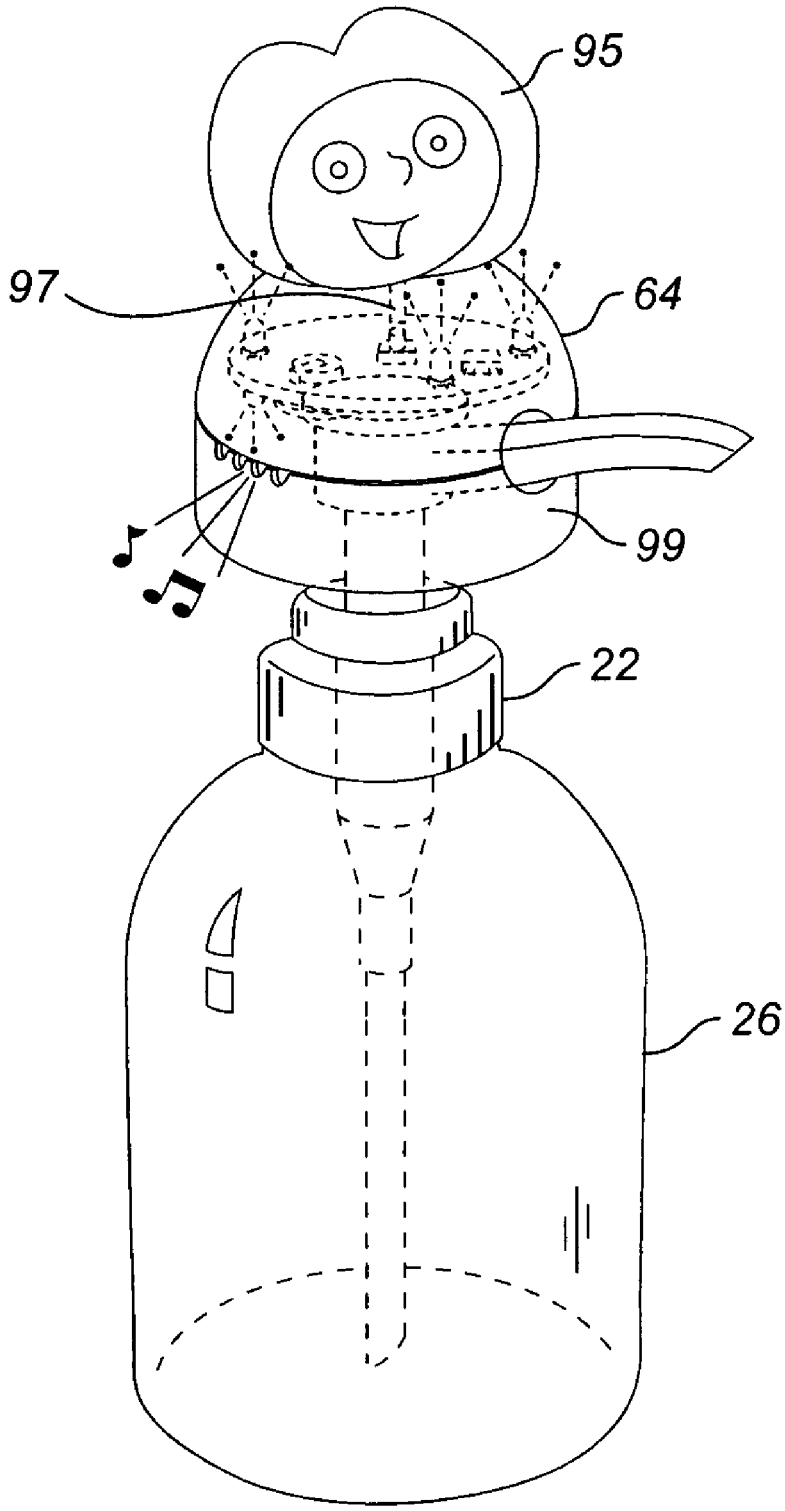
FIG. 2*e* is an isometric view of another embodiment similar to that of FIGS. 2*a*-2*d*, where a figurine in the shape of a head is attached to the case.

FIG. 2*e* illustrates another embodiment of the invention, in which a decorative object or figurine is molded integral with the top case 64. In the illustrated embodiment, the object is formed in the shape of a head 95 of an imaginary or fairytale person. Molded integral with the decorative object 95 is a post 97 which is aligned with the switch 90. Thus, when the user pushes on the object 95 to dispense the contents of the container 26, the post engages with the switch 90, thus activating it and turning on the light/sound module 74. In this embodiment, the bottom case 99 is shorter and does not cover the upper portion of the container 26 and cap 22.

FIGS. 3*a*-3*d* illustrate a lighted product dispenser 100 constructed according to another embodiment of the invention. In this embodiment, a light module 102 is fastened to the end of the suction tube 20, and is located inside the container 104. This lighted product dispenser 100 is well adapted for lighting the product inside the container 104 when the product is dispensed via the pump 14.

The container 104 is constructed with a bellows 105 located between the body of the container 104 and the threaded opening 106. When the pump 14 is depressed by the user to dispense the product, the entire pump assembly is pushed downwardly, and through the bellows 105, the light module 102 is caused to be pushed downwardly. When the bottom of the light module 102 is pressed against the bottom of the container 104, a switch in the module 102 is activated and light is emitted inside the container 104. The molded body of the light module 102 is constructed so that the liquid or gel contained in the container 104 is drawn through channels in the module 102 and up the suction tube 20 of the pump 14.

The container 104, including the bellows 105, is preferably blow molded using a clear plastic. The container 104 is also molded to include an indented bottom, shown as numeral 110. The indented bottom of the container 104 facilitates actuation of the switch in the light module 102 when the pump 14 is depressed. The type of pump 14 well adapted for use with this embodiment includes a suction tube 20 terminated with a tapered bottom end.

Figure 3A:
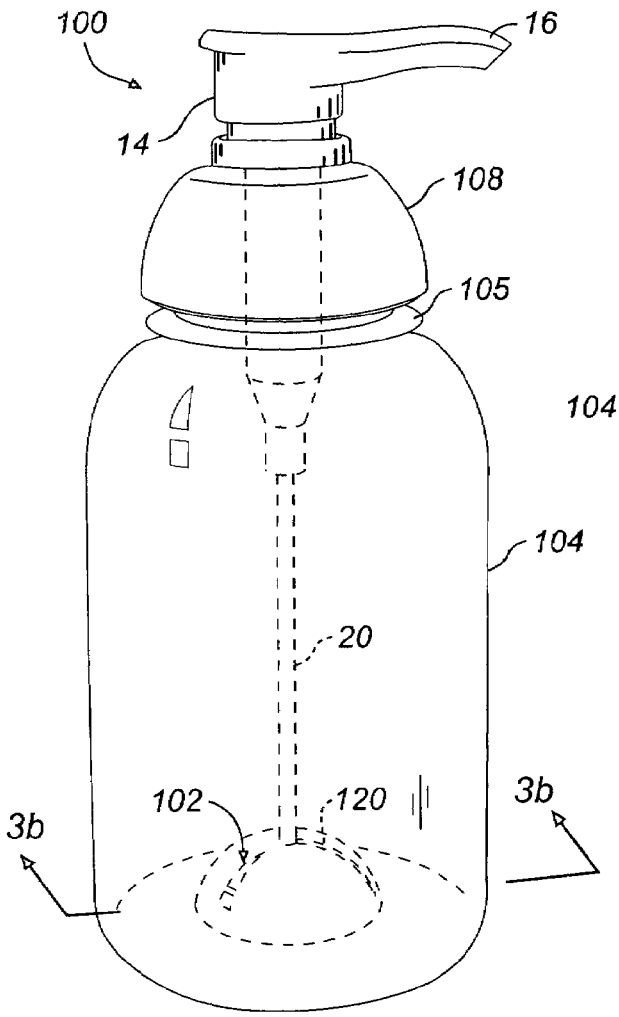
FIG. 3*a* is a side view of yet another embodiment of a pump-type dispenser according to the invention, in which a light module is attached to the supply tube of the pump.
Figure 3B:
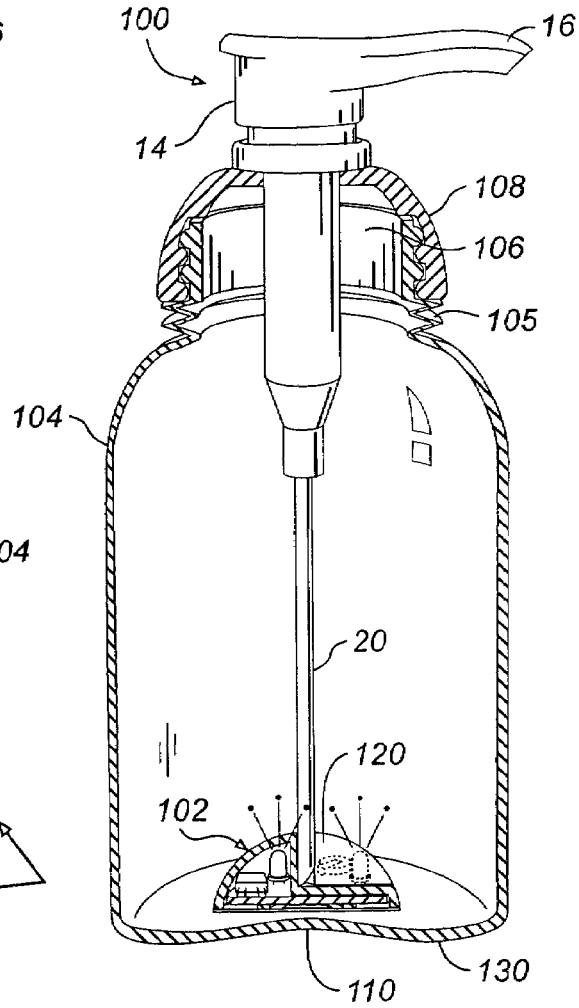
FIG. 3*b* is a cross-sectional view of the pump-type dispenser taken along line 3*b*-3*b* of FIG. 3*a;*
Figure 3D:
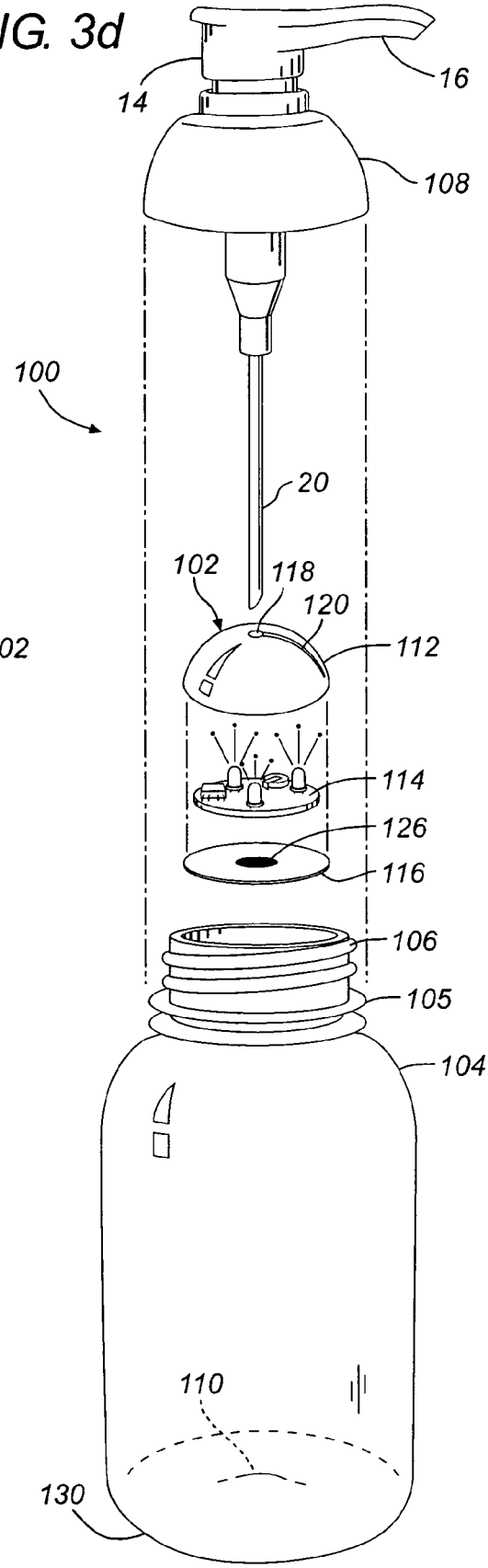
FIG. 3*d* is an exploded view of the various components of the pump-type dispenser of FIG. 3*a;*
Figure 3C:
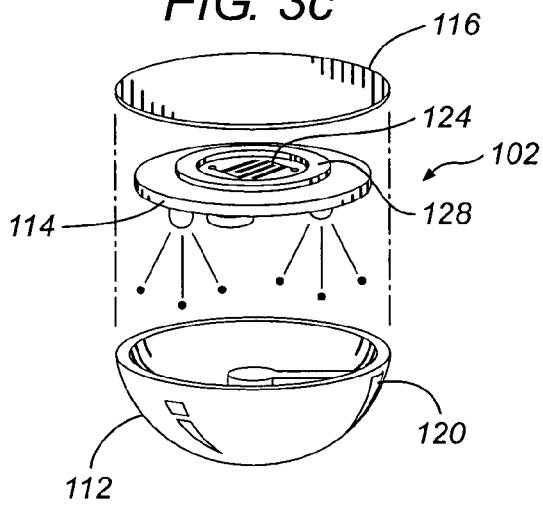
FIG. 3*c* is an exploded view of the light module of FIG. 3*a*, shown inverted.

With reference to FIGS. 3*b*-3*d*, the light module 102 is shown in more detail. For purposes of clarity, the light module 102 is shown upside down in FIG. 3*c*. The light module 102 includes a molded clear plastic case 112 in the shape of a dome, or hemisphere. A printed circuit board 114 is housed in the case 112, and a membrane 116 is sealed to the bottom annular edge of the case 112 to form a closure for the printed circuit board 114 in the module 102. The membrane 116 can be heat sealed or ultrasonically welded to the case 112. The bottom end of the suction tube 20 of the pump 14 frictionally fits within a cylindrical socket 118 formed in the case 112. A portion of the socket 118 opens to the outside of the case 112 by way of a slot 120, as shown in FIG. 3*d*. The slot 120 functions to allow the contents of the container 104 to be drawn therein and into the tapered end of the suction tube 20 during dispensing of the contents of the container 104. FIG. 3*b* is a cross-sectional view taken through the slot 120 which carries the fluid or gel to the suction tube 20.

The light module 102 includes a printed circuit board 114 with an integrated circuit, light emitting diodes, a battery, much like that described above. Included with the light module 102 is a pressure-activated switch. Formed on the bottom of the printed circuit board 114 is a pair of switch contacts formed as interleaved or serpentine conductor paths. The switch contacts are shown as 124 in FIG. 3*c*. Formed on the top of the membrane 116 is a conductive area which, when pressed into contact with the interleaved conductors 124, provides a short circuit therebetween and activates the integrated circuit to provide a light display via the light emitting diodes. The membrane 116 can be constructed as a thin plastic disk, about 0.006-0.008 inch thick, with a conductive carbon area 126. An annular spacer 128 is formed on the printed circuit board 114 around the switch contacts 124 to prevent inadvertent closure of the switch due to contact with the conductive area on the membrane 116. The annular spacer 128 can be about 0.03 inch thick. The spacer 128 can be constructed of foam and adhered to the bottom of the printed circuit board 114. Many other pressure sensitive switches can be employed with the light module 102.

The bottom 130 of the container 104 is formed with an indented area or bump 110 that is concave toward the internal portion of the container 104. The indented area 110 shown in FIGS. 3*b* and 3*d* is located just under the center of the membrane 116 and spaced therefrom a short distance, such as about 0.04 inch. Thus, when the pump 14 is pushed by the user to dispense the contents, the entire pump 14, including the suction tube 20 and the light module 102 is pushed downwardly, it being realized that the bellows 105 allows such movement. When the bottom of the light module 102, and more specifically the membrane 116, is pressed into contact with the indented area 110 of the container bottom 130, the membrane 116 flexes upwardly until the conductor area 124 contacts the interleaved contacts 124, thereby closing the pressure sensitive switch. When the pressure sensitive switch is closed, the integrated circuit is activated to light the light emitting diodes in a manner programmed in the integrated circuit. The integrated circuit is preferably programmed to provide the light display for a predetermined period of time, and then shut off. The upward-directed lights emit light into the contents of the container 104, thus providing an attention attracting effect. It can be appreciated that irrespective of the amount of the contents remaining in the container 104, the light is emitted therein when dispensing is in progress.

In the assembly of the lighted product dispenser 100, a container 104 equipped with a bellows 105 is employed to hold the contents to be dispensed, and to which the pump 14 and light module 102 assembly are attached. It should be noted that the bellows 105 can be molded with the container 104, or welded thereto to form an integral unit. Also, the bellows 105 can be formed as the midsection of the container 104, or at the bottom of the container 104.

The container 104 can be filled with the product to be dispensed in a conventional manner. Next, the light module 102 is attached to the end of the suction tube 20 by pushing the parts together to provide a friction attachment therebetween. The assembly including the pump 14 and the light module 102 is then inserted through the opening of the container 104, into the liquid or gel contents. The cap 108 of the pump is then threadably fastened to the opening of the container 104. The pump 14 can be pushed, even in the locked position, to test the light module 102 to verify that it works properly.

Figure 4:
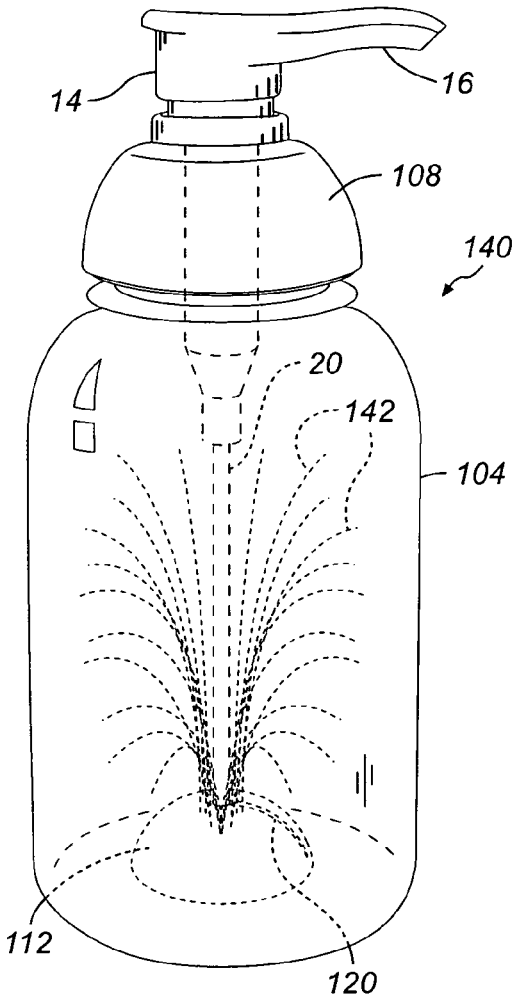
FIG. 4 is an isometric view of another embodiment of a pump-type dispenser, similar to that of FIG. 3*a*, but with fiber optic strands attached to the light module.

FIG. 4 illustrates another lighted product dispenser 140, similar to that described above in connection with FIGS. 3*a*-3*d*, but with plural fiber optic strands 142 connected to the case 112 of the light module. The strands 142 can be attached to the plastic case 112 in a conventional manner. In this embodiment, the case 112 can be constructed with an opaque plastic, and the strands 142 are embedded all the way through the case 112 so that the ends thereof are optically coupled to the light emitting diodes. With this arrangement, the only light that is emitted within the container is the light emitted from the free ends of each fiber optic strand 142. When the fiber optic strands 142 are immersed in a liquid-type product, and when the liquid is moved by movement of the container 104, the strands 142 are caused to move in a wave action with the liquid. As an alternative, the case 112 can be constructed of a clear plastic, whereupon light is emitted from both the case 112 and the fiber optic strands 142. Again, the contents of the container 104 can contain bubbles, flecks or glitter to cause additional light diffraction within the container 104.

Figure 5:
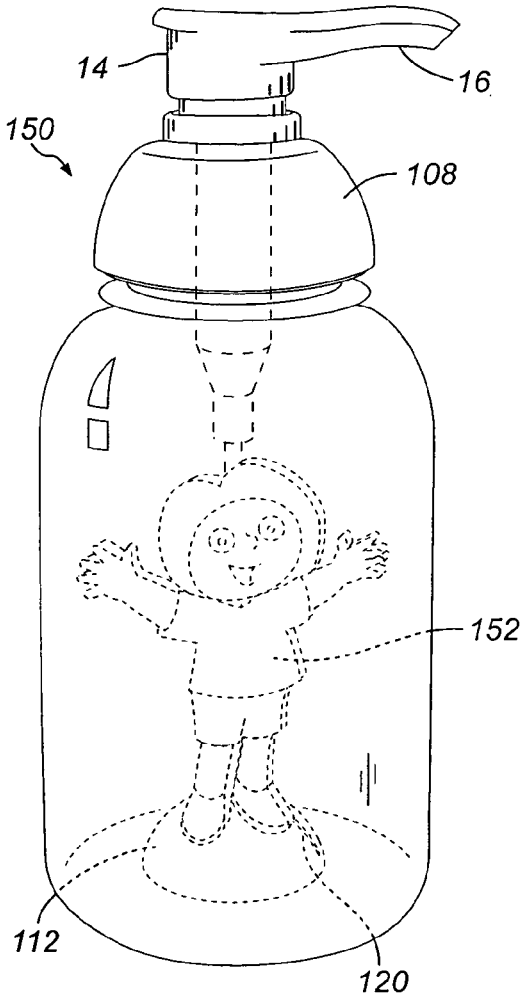
FIG. 5 is an isometric view of another embodiment of a pump-type dispenser, similar to that of FIG. 3*a*, but with a lightable object or figurine attached to the light module.

FIG. 5 is yet another embodiment of a lighted product dispenser 150 according to the invention. Here, a figurine 152 is attached to the case 112 of the light module to disperse light in the container 104. The figurine 152 can be any of a number of popular characters or objects that are attractive to the users. Preferably, the figurine 152 is constructed of a flexible plastic so that it can be deformed to push it through the opening in the container 104. Also, the figurine 152 is preferably constructed of a clear plastic film that has indentations for disbursement of the light rays within the container 10. The figurine 152 can also be constructed so that the light emitted from the light module 102 illuminates an outline of the figurine 152. Lastly, the figurine 152 can be constructed with a vertical bore to allow the suction tube 20 to be pushed therethrough and into the bore 118 of the light module case 112.

Figure 6A:
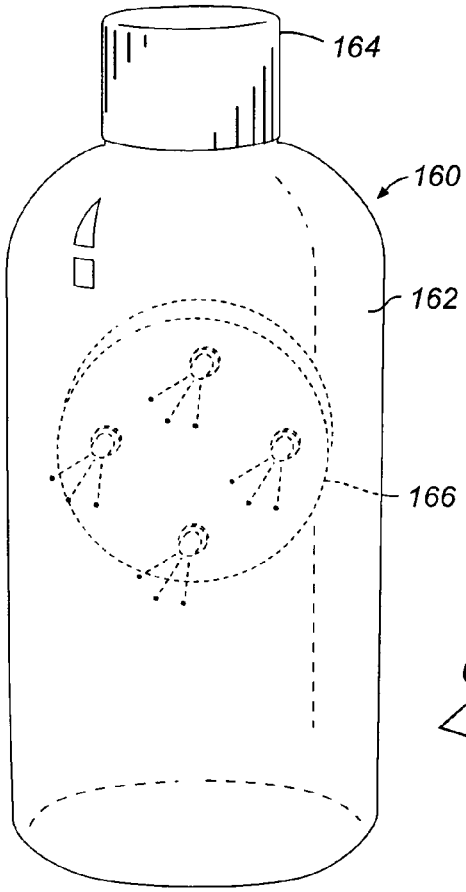
FIG. 6*a* is an isometric view of another embodiment of a press or squeeze-type dispenser according to the invention, in which the light source is located in a pocket formed in the outer surface of the dispenser container.
Figure 6B:
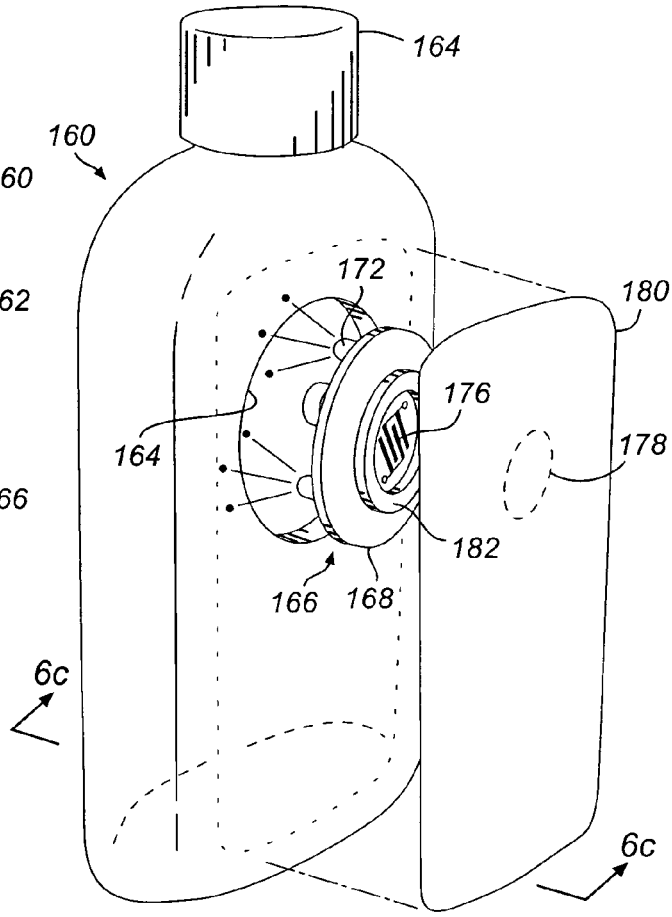
FIG. 6*b* is an oblique side view of the squeeze-type dispenser of FIG. 6*a*, showing in exploded form the light module and the adhesive label removed from the pocket of the container.
Figure 6C:
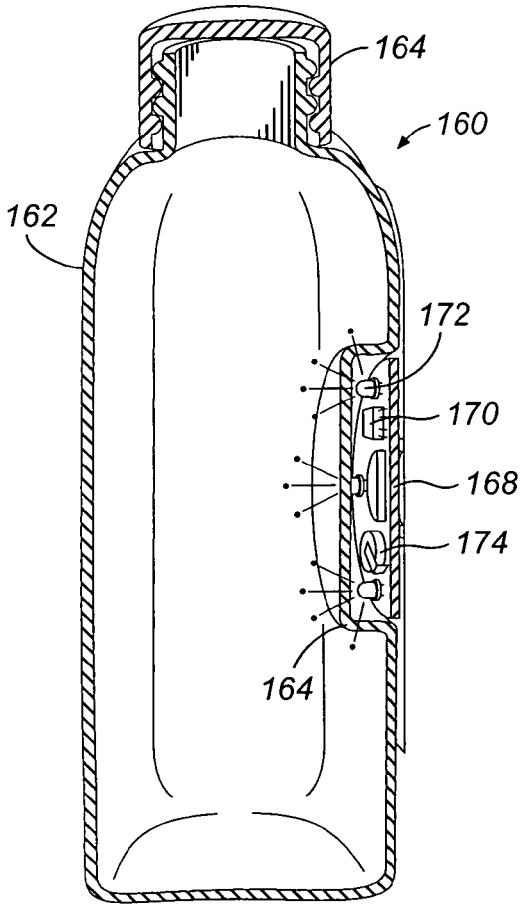
FIG. 6*c* is a cross-sectional view of the squeeze-type dispenser of FIG. 6*a*, showing the light module located in the container pocket, and with the adhesive label holding the light module in the container pocket.

FIGS. 6*a*-6*c* illustrate another embodiment of a lighted product dispenser 160. The lighted product dispenser 160 of this embodiment is the squeeze type, where the product is dispensed by squeezing the container 162, rather than by pumping the contents. The container 162 is preferably constructed of a clear plastic material, and capped by a conventional screw cap 164. Alternatively, the cap could be of the type with a swivel nozzle for allowing the contents to be squeezed therethrough.

According to a feature of the invention, the squeeze bottle container 162 is constructed with a pocket 164 in one side thereof, preferably a side of the container 162 that is grasped by the user to squeeze. The generally flat side of the container 162 is well adapted for forming the pocket 164 therein. The pocket 164 should be of the same footprint or outline shape as the light module 166, in the illustration—round. If the light module 166 were to be constructed as a square module, then the pocket should preferably also be square. The depth of the pocket 164 can be the same as the thickness of the light module 166. The formation of the container 162 with a pocket 164 can be achieved by conventional blow molding techniques.

The light module 166 can be constructed in a manner similar to those described above, namely with a printed circuit board 168 to which an integrated circuit 170 and light emitting diodes 172 are soldered. A battery 174 powers the circuits of the printed circuit board 168. A pressure sensitive switch is constructed using a pair of interleaved conductors 176 formed on the printed circuit board 168, and a contact area 178 formed on the inside surface of an adhesive product label 180. The adhesive covers the inside surface of the label 180, except for an area around the conductive area 178. The conductive area 178 can constructed by depositing carbon or other conductive material on the inside surface of the label 180. Alternatively, the label itself can be foil backed on the inside surface, where the foil provides the conductive area for short circuiting the interleaved contacts 176. A spacer ring 182 provides a mechanism in which the contact area 178 of the label 180 is spaced from the interleaved contacts 176, until a user presses on the sidewall of the container 162 to dispense the products, whereupon the pressure on the label side of the container 162 will cause the label 180 to deform slightly so that the contact area 178 short circuits the interleaved contacts 176. When the pressure sensitive switch is actuated in the manner noted, the integrated circuit 170 causes the light emitting diodes 172 to emit light in a programmed pattern for a predetermined period of time. As with the other embodiments of the invention described above, the light is emitted into the container 162, and into the contents thereof to provide the desired visual effect. As noted in FIG. 6*c*, the light emitting diodes 172 are situated so that the light emitted therefrom is directed laterally to the left into the container 162, as well as up, down and sideways through the walls of the pocket 164 into the container, i.e., a three dimensional dispersion of light into the container 162.

The light module 166 can be activated without dispensing of the contents of the container 162. The simple depression of the label 180 in the area opposite the conductive area 178 will activate the light module 166 without dispensing the product, as the cap 164 can remain on the container 162 during the activation period. This is because the container 162 and contents are sufficiently pliable to allow activation of the pressure sensitive switch without requiring the contents to be removed from the container 162. This feature of the invention enables the lighted product dispenser 160 to be displayed on store shelves and allows users to press on the product to produce a light display, without causing the product to be dispensed. The container 162 can have instruction for producing a demonstration light display, and the label 180 can be printed with a target for the area to be pressed, together with instructions to initiate the light display.

Figure 7:
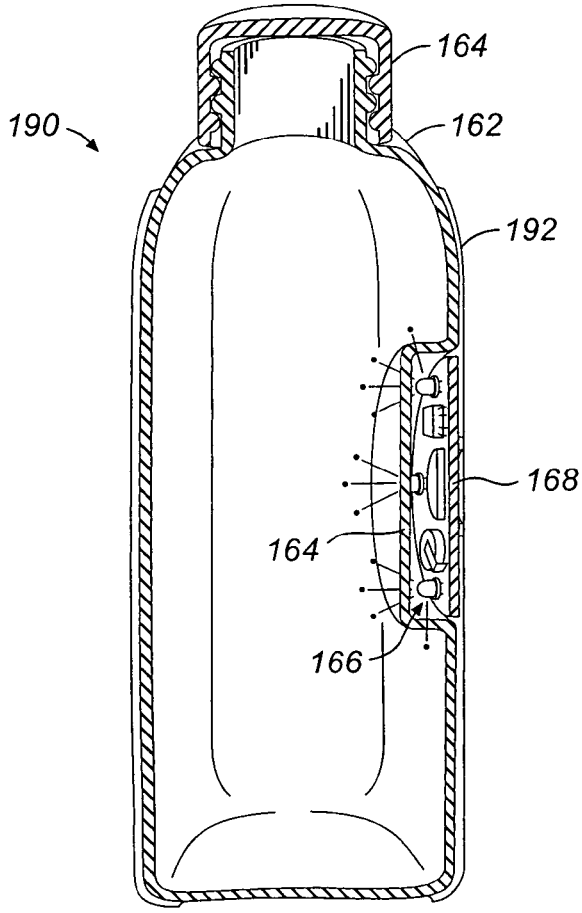
FIG. 7 is a cross-sectional view of another embodiment of a squeeze-type dispenser, similar to that of FIG. 6*a*, but where the light module is held in the container pocket with a heat shrinkable sleeve.

FIG. 7 illustrates another embodiment of a lighted product dispenser 190 of the squeeze bottle type. The construction of the container 162 and the light module 166 are substantially identical to that described above in connection with FIGS. 6*a*-6*c*. Rather than employing a label, the lighted product dispenser 190 of FIG. 7 uses a heat shrinkable sleeve 192. The heat shrinkable sleeve 192 can have printed thereon all of the information desired for marketing the product. Preferably, the heat shrinkable sleeve 192 would be constructed of a clear shrinkable material to allow the user to view the contents of the container 162. A conductive area (not shown) can be formed on the inside surface of the sleeve 192, and placed adjacent to the pressure sensitive switch. Alternatively, an annular band of a conductive material can be formed on the inside surface of the sleeve 192 so that the rotational orientation of the sleeve 192 during assembly is irrelevant. As can be seen from FIG. 7, the heat shrinkable sleeve 192 is shrunk over the bottom edge of the container 162, as well as over the curved top of the container 162 to maintain the sleeve 192 captured around the container 162.

FIGS. 8*a*-8*d* illustrate another product dispenser 200 of the invention in which a light module 202 is attached to the bottom of the container 204. The product dispenser 200 includes a conventional pump 14 for dispensing the contents via a spout 16. A cap 206 is threadably connected to a threaded opening 208 of the container 204. The bottom of the container 204 is cupped inwardly to accommodate the light module 202. The light module 202 includes one or more light emitting diodes, one shown as numeral 210, a battery 212, an integrated circuit 214, and a momentary switch 216, all mounted to a printed circuit board 218.

The container 204 is preferably molded with a cupped or domed bottom 220 (FIG. 8*b*) to accommodate the light module 202. Shapes other than domed shapes can be employed to accommodate the light module 202. The bottom of the container 204 further includes a first annular step or shoulder 222 that encircles the domed portion 220. A second annular step or shoulder 224 is formed between the first annular shoulder 222 and the outer annular bottom edge 226 of the container 204.

Figure 8A:
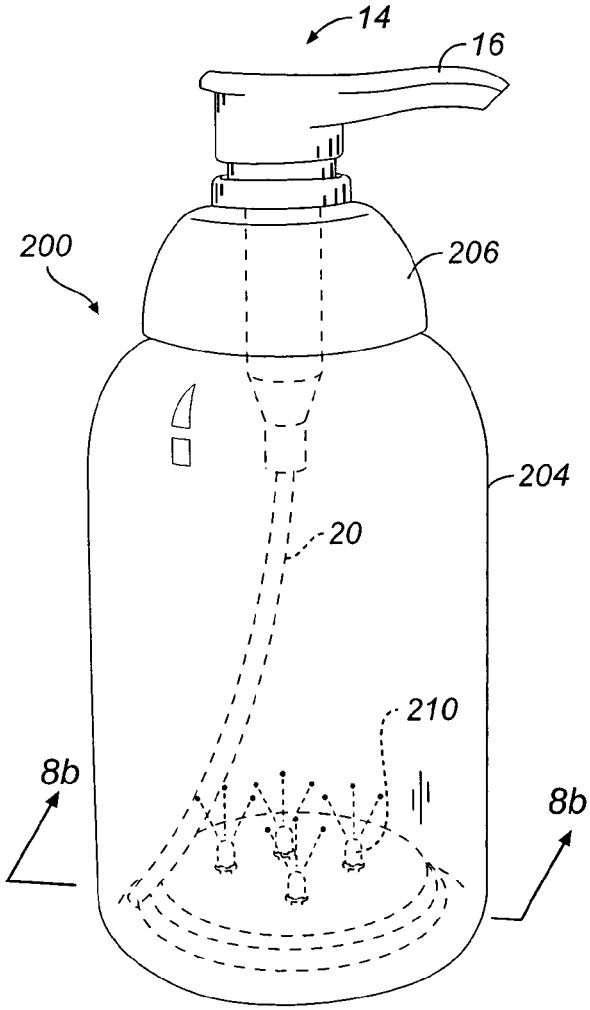
FIG. 8*a* is a side view of a pump-type dispenser according to another embodiment of the invention, in which a light module is attached to the bottom of the dispenser container.
Figure 8B:
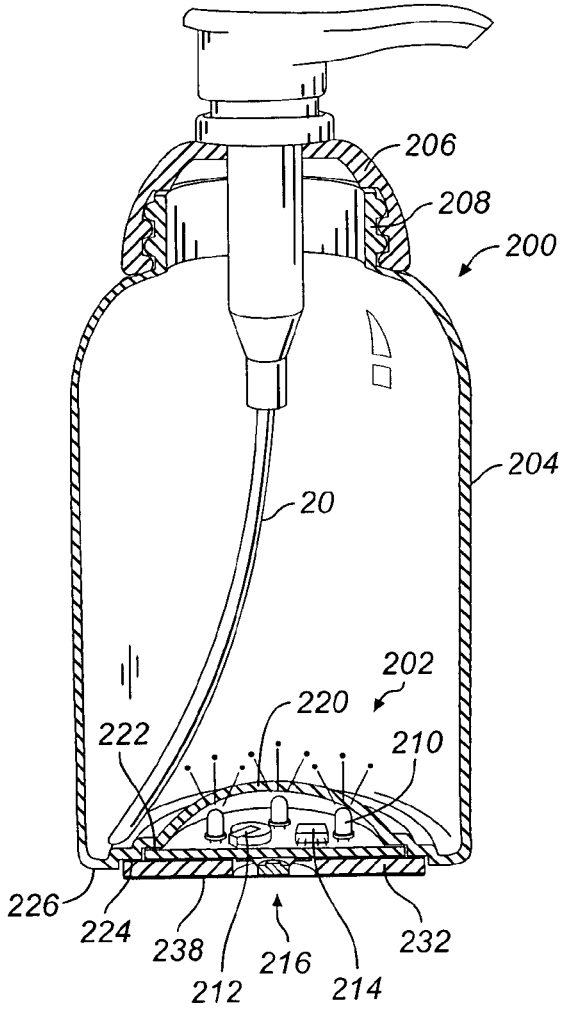
FIG. 8*b* is a cross-sectional view of the pump-type dispenser, taken along line 8*b*-8*b* of FIG. 8*a;*
Figure 8C:
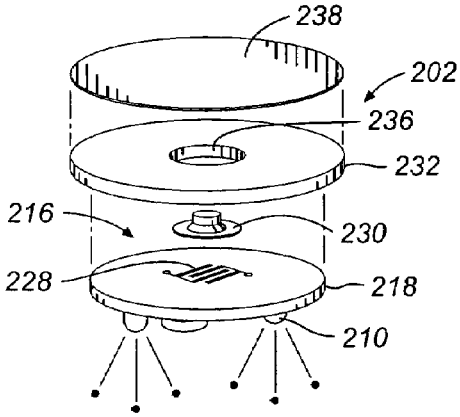
FIG. 8*c* is an exploded view of the light module, shown inverted.

The construction of the light module 202 is shown in detail in the exploded view of FIG. 8*c*. The light module 202 is shown upside down in this view to better understand the structural features thereof. The bottom of the printed circuit board 218 has formed thereon interleaved switch conductors, shown as numeral 228. The LEDs 210, battery 212, and integrated circuit 214 are connected together on the other side of the printed circuit board 218. The switch 216 of the light module 202 includes an elastomeric switch member 230 with a conductive area 232 (FIG. 8*d*) formed on the bottom side thereon which, when the elastomeric member 230 is depressed, makes contact with both interleaved switch contacts 228 of the printed circuit board 218, thereby closing the switch 216.

The elastomeric switch member 230 is of conventional construction, and of the type used with many electronic instruments, such as calculators, keyboards, toys, etc. The elastomeric material from which the switch member 230 is formed is very rubbery and flexible. The elastomeric switch member 230 includes a closed end with a conductive carbon area 232 formed therein. The conductive carbon area 232 is in the shape of a circular disk. The closed end of the switch member 230 is connected to a flat annular ring by a flared skirt which is deformable when the switch member 230 is depressed. Indeed, when the top of the closed end is manually pushed, it flexes sufficiently, together with the flared skirt, so that the conductive carbon area 232 therein contacts a surface on which the flat annular ring rests, in the instant case the interleaved switch contacts 228 of the printed circuit board 218. Normally, the full extent of compression of the elastomeric member 230 between the rest position and where contact is made between the conductive carbon area 232 and the interleaved switch contacts 228 is between about six thousandths to ten thousandths of an inch.

Figure 8D:
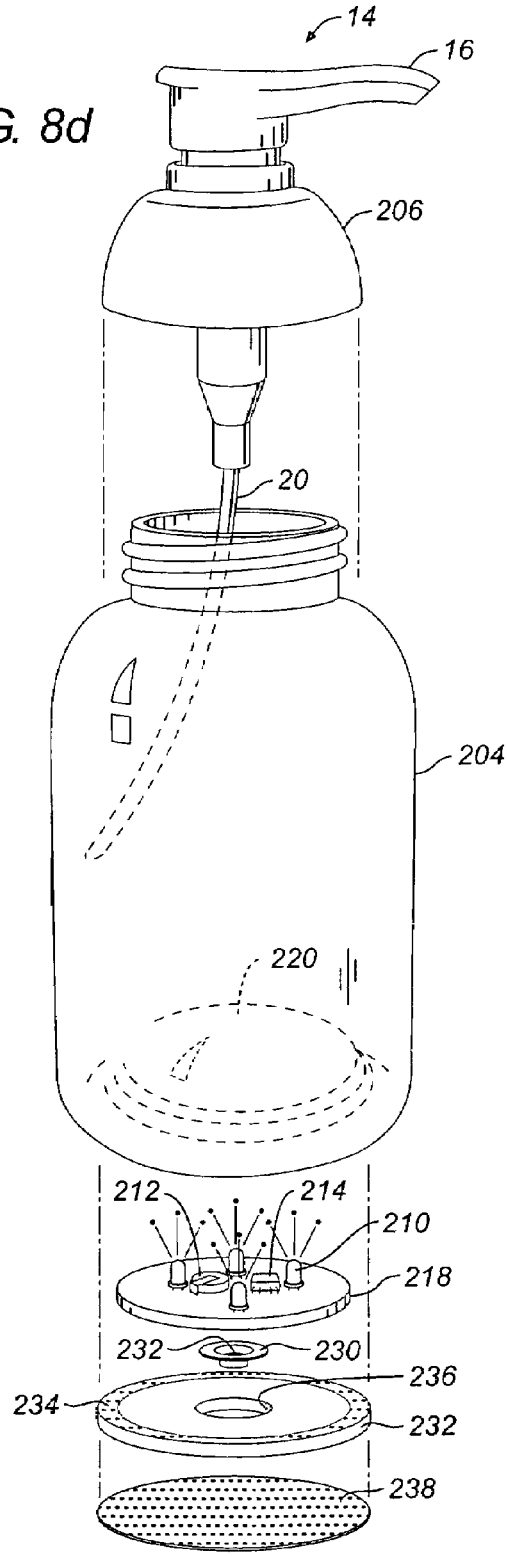
FIG. 8*d* is an exploded view of the various components of the pump-type dispenser of FIG. 8*a.*

During the assembly of the light module 202 with the container 204 of the product dispenser 200, the container 204 is preferably turned upside down. Then, the light module 202 is laid into the domed area 220 of the container bottom so that the circular edge of the printed circuit board 218 rests in the first step or shoulder 222. Next, a compressible foam disk 232 is positioned over the light module 202 so that the adhesive side of the foam disk 232 is adhered to the second step or shoulder 224. The adhesive is shown in FIG. 8*d* as numeral 234. Preferably, the thickness of the foam disk 232 is such that the elastomeric switch member 230 is recessed just slightly below the outer surface of the foam disk 232. The hole 236 formed in the middle of the foam disk 232 is registered over the interleaved switch contacts 228 formed on the printed circuit board 218. The elastomeric switch member 230 is then placed in the central hole 236 of the foam disk 232, with the flat annular ring resting around the interleaved switch contacts 228. Lastly, a thin Mylar film 238, with an adhesive coating on one side thereof, is applied to the exposed side of the foam disk 232. The Mylar film 238 captures the elastomeric switch member 230 within the hole 236 of the foam disk 232 and aligned with the interleaved switch contacts 228. The thicknesses of the various components of the light module 202 is such that the bottom surface of the Mylar film 238 extends beyond the annular bottom edge 226 of the container 204.

After the light module 202 is attached to the bottom of the container 204 in the manner described above, the container 204 can be filled with the contents, preferably a liquid or gel-based product that is capable of being pumped. The pump 14 is then attached to the container 204 by screwing the cap 206 onto the threaded opening 208 of the container 204. A label can be attached at any time during the process. A label with a reflective or shiny coating can be used to facilitate lighting of the interior of the container 204.

The light module 202 is activated in the following manner. When it is desired by the user to dispense the contents of the product dispenser 200, the user simply pushes down on the pump 14. This pressure applied to the top of the product dispenser 200 results in two corresponding actions. First, the plunger of the pump 14 is depressed, thus causing the contents of the container 204 to be dispensed. Secondly, the entire product dispenser 200 is pressed downwardly which compresses the foam disk 232 sufficiently such that the elastomeric switch member 230 is also compressed. The compression of the elastomeric switch member 230 causes closure of the switch 216, thus activating the light module 202. The activation of the light module 202 causes light to be emitted into the bottom of the container 204, and thus into the contents of the container 204. It can be appreciated that the dispensing of the container contents and the activation of the light module 202 occurs substantially simultaneously.

It is noted that the activation of the switch 216 requires that the foam disk 232 be compressed in order to also compress the elastomeric switch member 230. It can be determined by trial and error techniques the type of foam that is suitable, the density of the foam and the area of the foam disk 232 that rests on the surface on which the product dispenser 200 is laid. These parameters of the foam disk 232 can be selected to assure that with a full product dispenser, the light module will not be inadvertently activated without corresponding pressure applied to the pump 14.

While the preferred and other embodiments of the invention have been disclosed with reference to specific lighted product dispensers, it is to be understood that many changes in detail may be made as a matter of engineering choices without departing from the spirit and scope of the invention, as defined by the appended claims.

What is claimed is:

1. A product dispenser for dispensing a product by a user, comprising:

a container for containing the product, said container including an annular indented area around a bottom portion thereof;

a pump for dispensing the product from said container, said pump attached to a top of said container;

a light emitter for emitting light;

a light module for controlling the light emitter, said light module and said light emitter attached to a bottom of said container so that light is emitted into said container;

an electrical switch connected to said light module, said switch operable to electrically drive and activate said light emitter, said switch operates in response to pressure on said pump when dispensing the product to drive the light emitter for illuminating said container, said light emitter is activated by the user manually pressing the pump to dispense product; and a heat shrinkable sleeve shrunk around at least a bottom portion of said container and shrunk into and around the annular indented area of said container to prevent axial movement of the heat shrinkable sleeve about an axial axis of said container, and said heat shrinkable sleeve shrunk around at least a portion of said light module to maintain said light module attached to said container.

2. The product dispenser of claim 1, wherein said container has a generally flat bottom, and wherein said light emitter is positioned to illuminate an interior of said container through the generally flat bottom of said container.

3. The product dispenser of claim 1, wherein said switch is pressure sensitive, with a pressure sensitivity that operates when said pump is pushed, but does not operate when subjected only to the weight of said product dispenser full of the product.

4. The product dispenser of claim 1, wherein said switch includes a body portion, and a movable portion that is responsive to pressure applied thereto, and where the body portion of said switch is carried by said container and thus fixed against movement with respect to said container.

5. The product dispenser of claim 1, wherein said heat shrinkable sleeve is constructed to obscure from view said light module.

6. The product dispenser of claim 5, wherein said heat shrinkable sleeve is opaque to thereby hide said light module from view.

7. The product dispenser of claim 6, wherein said light module is constructed of a material that allows light to be transmitted thorough a wall thereof into a bottom of the container of said product dispenser.

8. The product dispenser of claim 1, further including advertising concerning the product contained in said container, and said advertising is located on said heat shrinkable sleeve.

9. A method of making a product dispenser, comprising;

attaching a pump having a locked position and an unlocked position to a top of a container of the product dispenser, said product dispenser dispenses a product when pressure is applied to the pump when in the unlocked position, and said pump is constructed for not dispensing the product when in said locked position and when pressure is applied to said pump;

selecting said container having an annular indented area around a bottom portion thereof;

electrically connecting an emitter producing a sensory output to an electronic module so that when said electronic module is activated, said emitter is driven to produce a sensory output;

attaching a switch at a bottom of said electronic module in a position so that when said product dispenser is placed on a surface and said pump is depressed, said switch is activated to activate said electronic module;

placing the electronic module under said product dispenser filled with the product, and placing a heat shrinkable sleeve around at least a bottom portion of said container and around said electronic module;

shrinking the heat shrinkable sleeve around the product filled container and into an annular indented area located around a lower portion of said container, and shrinking the heat shrinkable sleeve around the electronic module to attach the electronic module to the bottom of said container of the product dispenser; and shipping the product dispenser with the pump in said locked position so that a potential customer can experience the sensory output of said emitter in a retail store by pressing on the pump without dispensing the product.

10. The method of claim 9, further including selecting the switch that is pressure sensitive, with a pressure sensitive switch mechanism that operates when said pump is pushed, but does not operate when subjected only to the weight of said product dispenser full of the product.

* * * * *